US005495781A

United States Patent [19]

Wirth

[11] Patent Number: 5,495,781

[45] Date of Patent: Mar. 5, 1996

[54] ROOF SHINGLE REMOVER

[76] Inventor: Sterling Wirth, 1101 N. ISt, Tacoma, Wash. 98403

[21] Appl. No.: 273,314

[22] Filed: Jul. 11, 1994

[51] Int. Cl.[6] ..... E04D 15/00

[52] U.S. Cl. ..... 81/45; 254/131

[58] Field of Search ..... 81/45; 254/120, 254/131

[56] References Cited

U.S. PATENT DOCUMENTS 2,714,907 8/1955 Peck ..... 81/45

4,183,503 1/1980 Ward ..... 254/131

*Primary Examiner*—James G. Smith

[57] ABSTRACT

An improved hand tool for removing shingles and accompanying roofing material from a roof. Tool (10) has a handle (14) attached to an assembly (13) consisting of a plurality of members (16*a* and 16*b*) disposed in a plane perpendicular to the longitudinal axis of handle (14). Members (16*a* and 16*b*) are disposed in a straight longitudinal axis in relation to each other. Assembly (13) incorporates an elongated tongue (18) disposed in a plane perpendicular to the central axis of the plurality of members (16*a* and 16*b*). Elbow (15) allows for tongue (18) to be attached to assembly (13) at a predetermined angle to handle (14). Members (16*a* and 16*b*) are attached to assembly (13) at a point immediately above attachment of tongue (18). Tongue (18) can be inserted under roofing shingles via gaps (25) in skip sheeting (30) boards that shingle roofs are commonly nailed to. Members (16*a* and 16*b*) remain on top of skip sheeting (30). Downward pressure on handle (14) uses members (16*a* and 16*b*) as a fulcrum to provide lift to tongue (18) thereby lifting shingles from roof.

1 Claim, 5 Drawing Sheets

ROOF SHINGLE REMOVER

BACKGROUND—FIELD OF INVENTION

This invention relates to hand tools for removing shingles in single or multiple layers; from existing roofs.

BACKGROUND—DESCRIPTION OF PRIOR ART

Heretofore, shingle removing tools have required considerable force exerted by the worker in order to force the tool under the shingles nailed on the roof. The shingles must actually be lifted slightly from the roof to provide a space allowing the tool access under them. Furthermore; progression of the tool under the shingles is hindered by the presence of the shingle nails, which must be pulled out or sheared off in order for the tool to proceed under the shingles.

Typical of such devices are those described and illustrated in the following United States Patents: U.S. Pat. No. 5,100,791 to Williams (1990); U.S. Pat. No. 5,280,676 to Fieni (1993); U.S. Pat. No. 4,663,995 to Amundson (1986); and U.S. Pat. No. 5,159,859 to Whitesell (1991). All of the aforementioned tools suffer various drawbacks in operation. Chief among these is the considerable effort that is necessary to fit the tool under the shingles, and the limited amount they can be inserted under the shingles. These problems are due to interference from the shingle nails; and also the fact that there must be some lifting of the shingles and nails in order for the tool to be inserted under them at all.

OBJECTS AND ADVANTAGES

Accordingly, several objects and advantages of my invention are to provide a prying tool constructed in such a way as to fit in the gaps between the skip sheeting boards that shingle roofs are commonly nailed to. What this accomplishes is to place the lifting portion of the tool under a larger portion of roofing material without having to be forced by the worker or halted by existing nails; thereby conserving considerable effort by the worker over prior art. Furthermore, allowing a larger portion of roofing shingles to be lifted and rolled before proceeding; a distinct advantage over prior art. These and other objects and advantages will become apparent from a consideration of the ensuing description and drawings.

DRAWING FIGURES

REFERENCE NUMERALS IN DRAWINGS

| | |
|---|---|
| 10 invention | 14 handle |
| 16a and 16b plurality of members | 15 elbow |
| 18 elongated tongue | 11 bolt |
| 20 washer | 12 nut |
| 26a and 26b holes for bolt | 28a and 28b splines |
| 13 assembly at bottom end of invention | |
| 22 roofing shingles on a roof | |
| 30 skip sheeting boards that wood shingles are commonly nailed to | |
| 25 gaps in between skip sheeting boards | |
| 24 roof rafters under skip sheeting partially exposed | |

Description—FIGS. 1 to 7

Figure 1A:
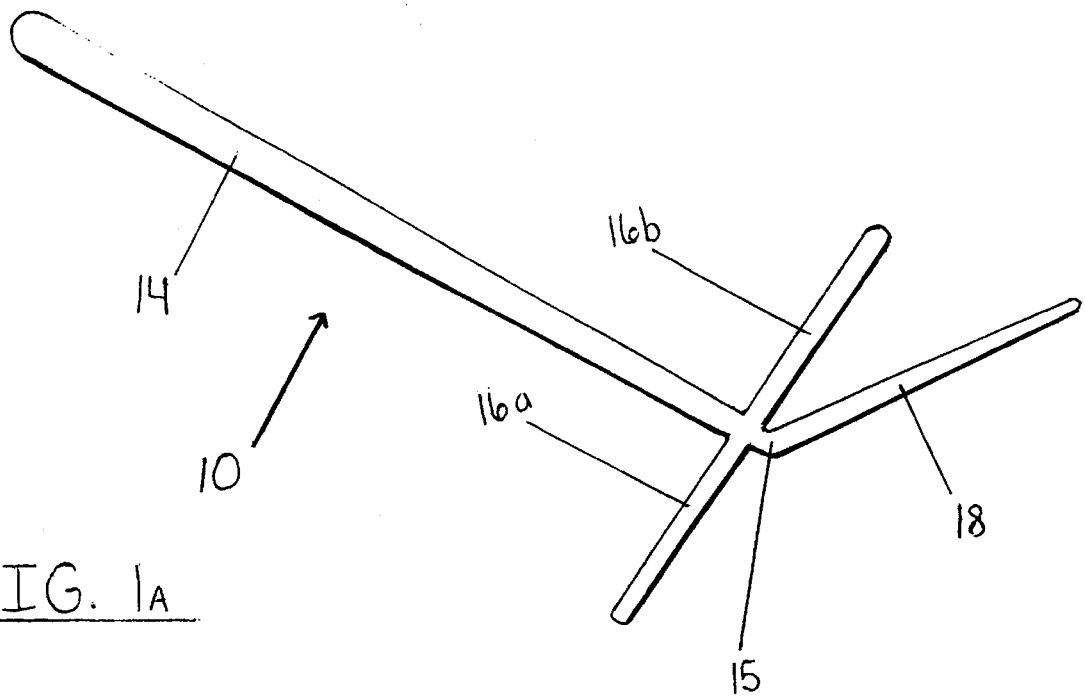
FIG. 1A is a perspective view of my invention.
Figure 1B:
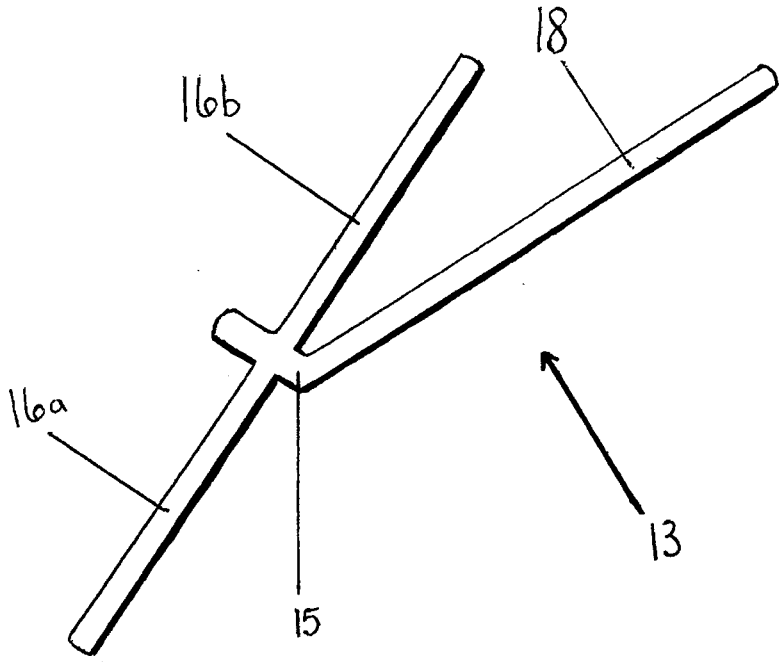
FIG. 1B is an enlarged perspective view of assembly at bottom end of the invention.
Figure 2:
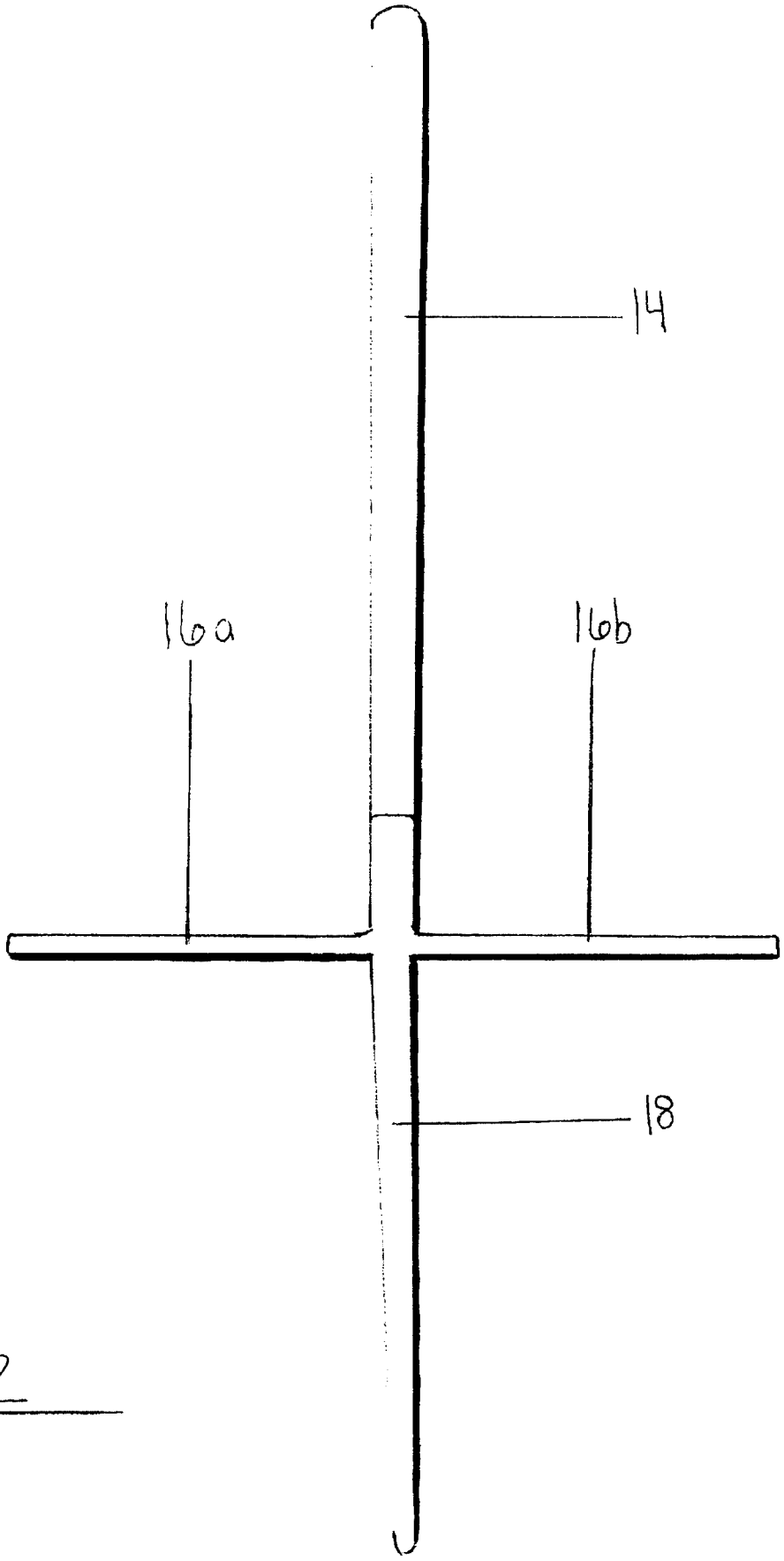
FIG. 2 is a plan view of the invention.
Figure 3:
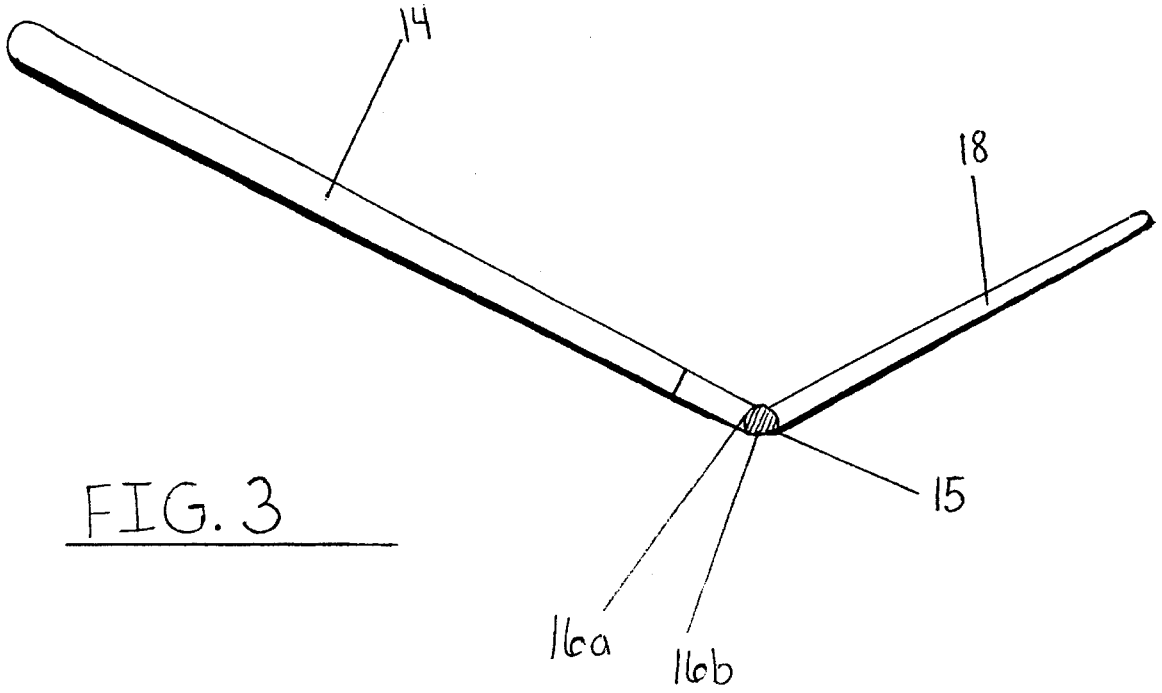
FIG. 3 is a side view of the invention.
Figure 4:
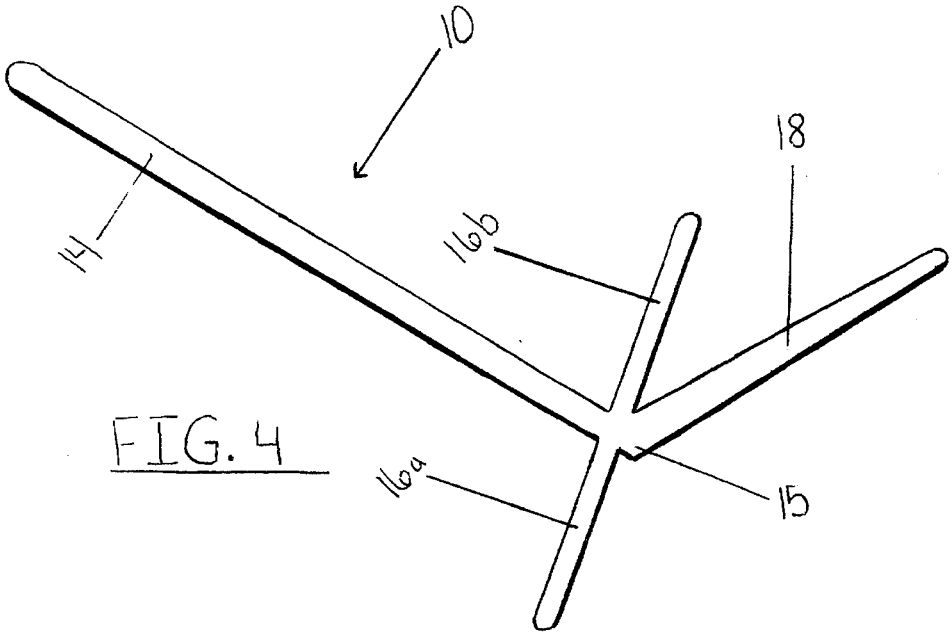
FIG. 4 is a perspective view of an alternate embodiment of assembly at bottom end of invention.
Figure 6:
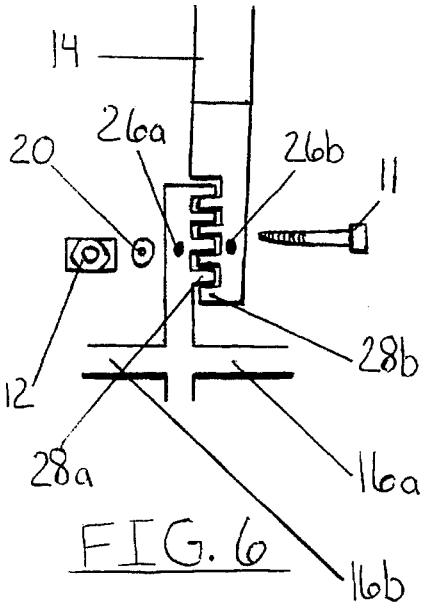
FIG. 6 is an exploded fragmentary plan view of alternate embodiment of assembly at bottom end of invention.
Figure 5:
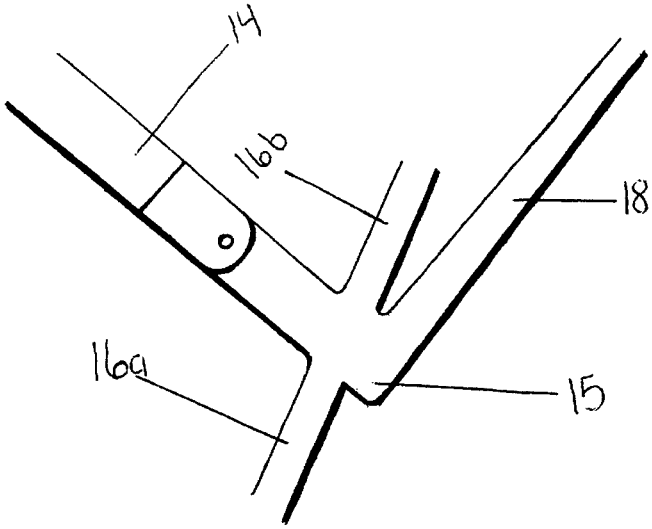
FIG. 5 is a perspective view of a fragmentary enlargement of alternate embodiment of assembly at bottom end of invention.
Figure 7:
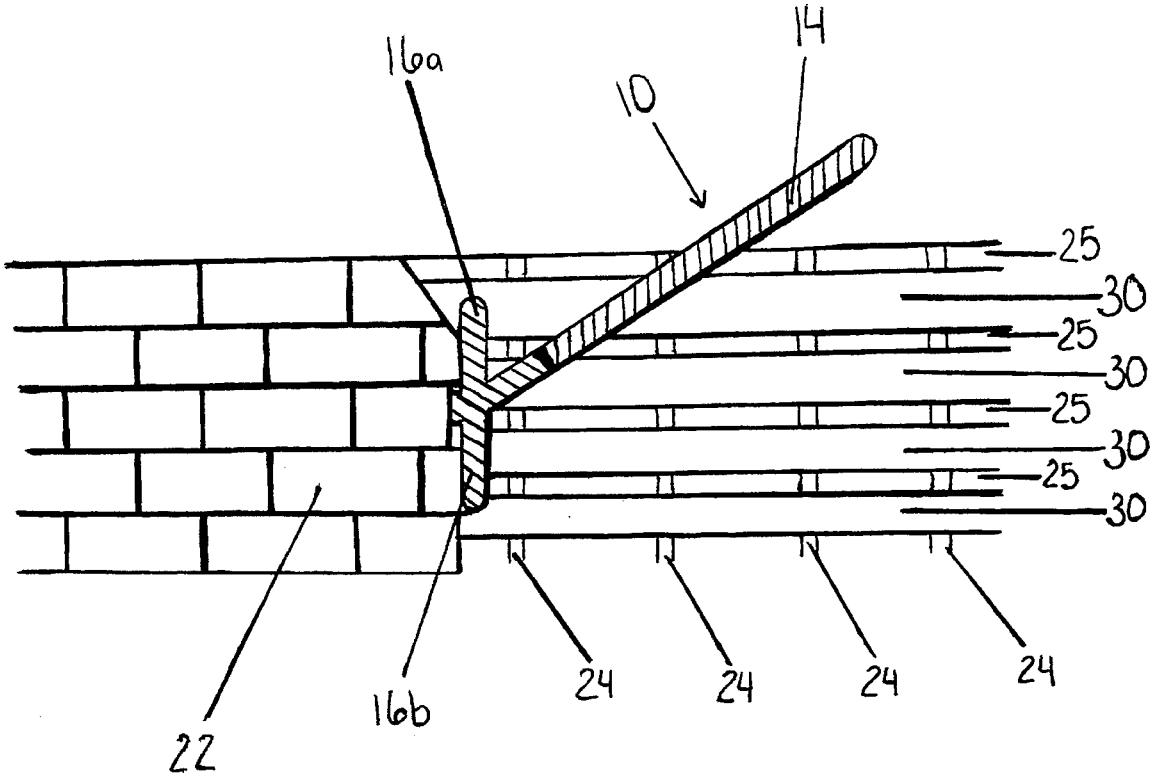
FIG. 7 is a perspective view of the invention in operation.

FIG. 1A shows a perspective view of a basic version of my invention. Tool 10 comprises a metal handle 14 attached to a welded metal assembly 13. Assembly 13 comprises a plurality of members **16*a* and 16*b* of equal length disposed in a plane perpendicular to the longitudinal axis of handle 14. Members 16*a* and 16*b* are further disposed in a longitudinal axis in relation to each other. Assembly 13 is further comprised of an elongated tongue 18 disposed in a plane perpendicular to the central axis of members 16*a* and 16*b*. Tongue 18 is attached to assembly 13 at an elbow 15 which positions tongue 18 at an angle to handle 14 of 130 degrees. Elbow 15 allows for members 16*a* and 16*b* to be attached at one end to assembly 13 at a point immediately above juncture of tongue 18 and elbow 15. Tongue 18 has one free end for extending under shingles in gap 25, as shown in FIG. 7. FIG. 6 shows an exploded fragmentary plan view of alternate embodiment of tool 10 with an adjustable attachment for assembly 13. The alternate embodiment consists of a bolt 11, a nut 12 and a washer 20. Holes 26*a* and 26*b* are provided for bolt 11. Corresponding splines 28*a* and 28*b* mash in such a way as to lock assembly 13 and handle 14** in position at a predetermined angle.

FIG. 7 shows roofing shingles 22, boards used as skip sheeting 30, gaps 25 between skip sheeting 30 and partially exposed roof rafters 24 under skip sheeting 30.

Operation—FIGS. 6 and 7

In operation of tool 10, as shown in FIG. 7; tongue 18 may be inserted in gap 25 in between skip sheeting 30 extending tongue 18 under roofing material 22. Members **16*a* and 16*b* rest on top of skip sheeting 30. When downward pressure is applied to handle 14 of tool 10, members 16*a* and 16*b* act as a fulcrum to provide lift to tongue 18**, thereby lifting the roofing material, nails and all.

Operation of tool 10 with the embodiment of the adjustable attachment of assembly 13 is similar. The variation being that bolt 11 and nut 12 can be loosened and removed so angle of handle 14 to assembly 13 can be altered. Splines **28*a* and 28*b* can then again be secured at new angle by bolt 11 and nut 12. The purpose of the adjustment made would be to tailor the angle of handle 14 to assembly 13** to suit working on a roof of different incline.

Thus the reader will see that the invention provides a superior hand tool that facilitates the removal of shingles and old roofing from existing structures; eliminating the need to force the tool between the shingle and the roof, or sheeting. Furthermore, the roofing nails cannot hinder inserting tool 10 under the roofing material, and are thereby circumvented. The foregoing embodiments of the invention are considered illustrative only and are intended to cover all changes and modifications of the examples of the invention herein chosen. Consequently, the disclosed invention is not limited by the exact structure and use shown and described, as many other variations are possible. For example: handle 14 could be longer so as to provide more leverage; members 16*a* and 16*b* could be longer to cover more boards of skip sheeting 30. Additionally, members 16*a* and 16*b* could be provided with a pair of couples to use in attaching a rectangular plate under members 16*a* and 16*b* for the purpose of increasing the surface area of members 16*a* and 16*b* in situations where skip sheeting 30 is broken or decayed. Members 16*a* and 16*b* could be deployed at a higher or lower point above elbow 15 to a allow for working with roofs where skip sheeting is made of thicker or thinner boards. Elongated tongue 18 could be different lengths or thicknesses. The angle that is provided by elbow 15 in the fixed angle embodiment could be fixed in a different angle to accomodate operation on roofs of different incline. In the adjustable embodiment, alternate methods for adjusting the angle of handle 14 to assembly 13, other than what is shown in FIG. 6, could be provided. Handle 14 could be provided with hand grips. The entire invention could be constructed from a variety of materials. Accordingly, the scope of the invention should be determined not by the embodiments illustrated, but by the following claims and their legal equivalents.

I claim:

1. A hand held Roof Shingle Remover used for lifting, loosening and removing existing roofing shingles from roof structures comprising:

(a) a relatively long rigid handle having a straight longitudinal axis;

(b) said handle extends from one free end downward to an elbow on a lower end of said handle;

(c) a plurality of members of substantially equal length attached at one end immediately above said elbow;

(d) said members are disposed in a straight longitudinal axis in relation to each other;

(e) said members are disposed in a plane perpendicular to the longitudinal axis of said handle;

(f) said members are of a length to cover at least two boards of skip sheeting boards that wood shingles are commonly nailed to;

(g) an elongated tongue attached at one end to said elbow;

(h) said elbow disposes said elongated tongue at a predetermined angle to longitudinal axis of said handle; and (i) said elongated tongue is disposed in a plane perpendicular to the longitudinal axis of said plurality of members; whereby (j) said elongated tongue utilizes one free end as a means to extend under shingles by way of gaps in skip sheeting boards that wood shingles are commonly nailed to; and (k) said plurality of members rest on top of and span at least 2 (two) boards of skip sheeting boards to act as a fulcrum means providing leverage to said elongated tongue to lift shingles from roof when downward pressure is applied to said handle.

* * * * *